US010551012B2

(12) United States Patent
Schorr, III

(10) Patent No.: US 10,551,012 B2
(45) Date of Patent: Feb. 4, 2020

(54) WRIST-MOUNTED FLASHLIGHT WITH REMOTE CONTROL SWITCH

(71) Applicant: Jerome Otto Schorr, III, Bel Air, MD (US)

(72) Inventor: Jerome Otto Schorr, III, Bel Air, MD (US)

( * ) Notice: Subject to any disclaimer, the term of this patent is extended or adjusted under 35 U.S.C. 154(b) by 0 days.

(21) Appl. No.: 16/144,348

(22) Filed: Sep. 27, 2018

(65) Prior Publication Data

US 2019/0093835 A1 Mar. 28, 2019

Related U.S. Application Data

(60) Provisional application No. 62/563,791, filed on Sep. 27, 2017.

(51) Int. Cl.

| | |
|---|---|
| ***F21L 4/00*** | (2006.01) |
| ***F21V 23/00*** | (2015.01) |
| ***F21V 23/04*** | (2006.01) |
| ***F21V 21/08*** | (2006.01) |
| *F21Y 115/10* | (2016.01) |

(52) U.S. Cl.

CPC ..... *F21L 4/005* (2013.01); *F21L 4/00* (2013.01); *F21V 21/0816* (2013.01); *F21V 23/001* (2013.01); *F21V 23/0435* (2013.01); *F21Y 2115/10* (2016.08)

(58) Field of Classification Search

CPC ..... F21L 4/005; F21L 4/00; F21V 21/0816; F21V 23/001; F21V 23/0435; F21V 33/0004; F21V 33/0008; F21V 17/00; F21V 17/10; F21V 21/00; F21V 21/08; F21Y 2115/10

See application file for complete search history.

(56) References Cited

U.S. PATENT DOCUMENTS

| | | | | |
|---|---|---|---|---|
| 1,173,269 | A | 2/1916 | Heidemann | |
| 1,267,436 | A | 5/1918 | Martin | |
| 4,788,631 | A | 11/1988 | Fuller | |
| 5,086,378 | A * | 2/1992 | Prince ..... | F21V 21/08 362/103 |

(Continued)

FOREIGN PATENT DOCUMENTS

| | | |
|---|---|---|
| JP | HEI 7-323097 | 12/1995 |
| JP | 3057778 | 6/1999 |

(Continued)

*Primary Examiner* — Bao Q Truong
*Assistant Examiner* — Glenn D Zimmerman
(74) *Attorney, Agent, or Firm* — Royal W. Craig; Gordon Feinblatt LLC

(57) ABSTRACT

A wrist-worn flashlight can include a lighting unit attached to a wrist band for allowing a user to wear the device on the wrist and a remote control that attaches to a finger of the user for allowing the user to control the light unit by finger. The remote control may allow the user to power the lighting unit on/off and/or switch between multiple lighting modes. The wrist-worn flashlight can enable a user to operate and toggle between modes using the user's fingertips. The flashlight can illuminate a target and free both hands of the user to work on the target. Moreover, the flashlight can allow the user to directionally train the beam on the target as desired and control the beam without diverting it.

20 Claims, 4 Drawing Sheets

(56) References Cited

U.S. PATENT DOCUMENTS

| | | | | |
|---|---|---|---|---|
| 5,193,896 | A * | 3/1993 | Oberlander | B62J 6/00 362/103 |
| 5,365,213 | A | 11/1994 | Paull | |
| 6,902,290 | B2 * | 6/2005 | Watts | F21V 21/0885 362/103 |
| 7,163,308 | B2 * | 1/2007 | Ferrari | A41D 19/0157 2/159 |
| 7,441,918 | B2 | 10/2008 | Kim | |
| 8,398,255 | B2 * | 3/2013 | Starogiannis | F21L 4/04 2/160 |
| 9,752,762 | B1 * | 9/2017 | Poe, III | F21V 21/0832 |
| 2008/0062676 | A1 | 3/2008 | Masuda | |
| 2011/0182057 | A1 * | 7/2011 | Watson | B23B 45/00 362/103 |

FOREIGN PATENT DOCUMENTS

| | | |
|---|---|---|
| JP | 2004-316050 | 11/2004 |
| JP | 3114125 | 9/2005 |

* cited by examiner

WRIST-MOUNTED FLASHLIGHT WITH REMOTE CONTROL SWITCH

CROSS-REFERENCE TO RELATED APPLICATION(S)

The present application derives priority from U.S. Provisional Patent Application No. 62/563,791 filed 27 Sep. 2017.

BACKGROUND OF THE INVENTION

1. Field of the Invention

The present invention relates generally to flashlights and, more particularly, to such a flashlight system adapted to be worn on the wrist of a user and a distal finger-tip remote control that is attached to the user's finger to allow the user to power the light unit on/off and/or switch between multiple lighting display modes.

2. Description of the Background

Flashlights are commonly used in a wide variety of situations to illuminate areas where normal lighting is not readily available. The conventional solution is to hold a flashlight or use a headlamp to create the desired lighted area. Although wrist-mounted flashlights are also available, they are less commonly used in most situations. These devices all require the user to fully occupy at least one hand with the operation of the flashlight when they want to turn it on, off, or cycle through different lighting modes.

Many people including military personnel, police, firemen, campers, hikers, mechanics, fishermen, hunters, electricians, etc. often find themselves in a situation where they need a flashlight but need to use the hand that would otherwise hold and operate the flashlight. For example, in the case of a policeman, he may need to use a flashlight while holding a firearm with both hands. Both hands may be necessary to keep a steady aim on the intended target. Unless he removes at least one hand from the firearm, he would have difficulty in activating the flashlight. In another example, a camper may be assembling a tent in the dark and need to use a flashlight while holding multiple parts of the tent assembly. The camper would find it difficult to continue to use both hands while activating the flashlight as he assembles the tent. In yet another example, a pilot may require the use of a flashlight to illuminate maps or equipment panels in a cockpit. The pilot would find it difficult to continuously pilot the aircraft and operate all necessary controls and communications while searching for a flashlight in the darkness of a cockpit.

It would be greatly desirable to allow such persons to use a flashlight without removing any hands from the current task. There are a number of patents that show wrist-mounted and hand-mounted flashlights. For example, U.S. Pat. No. 4,788,631 improves on the standard wrist-mounted flashlight by incorporating a sliding lens with white and red sections that engage the electrical contact with the batteries and energize the light.

U.S. Pat. App. No. 20080062676 incorporates lighting components that can be easily attached or detached from a user's fingers allowing the light to illuminate the area around the user's hand. Light gloves have also been introduced in Japanese Pub. No. 2004-316050, Japanese Utility Model Reg. No. 3057778, Japanese Pub. No. HEI 7-323097, and Japanese Utility Model Reg. No. 3114125 that are configured so that the lighting components such as fairy lights or light-emitting diodes (LEDs) are attached to the finger parts of the gloves. As a result, these lighting devices provide varying amounts of light in the vicinity of the hand, but none of them provide an easy single-finger mounted switch to remotely operate a wrist-mounted flashlight with a significant light source while continuing to work without interrupting the hand from its normal activity.

There have been several efforts to improve flashlight systems that include flashlights and signaling lights into hand, arm and wrist attachments. For example, U.S. patent application Ser. No. 1,173,269; U.S. patent application Ser. No. 1,267,436; and U.S. Pat. No. 5,365,213 include bulky devices with activating switches that are incorporated into gloves, wrist attachments, and larger body attachments that require excessive components and limit the use and operation of the devices. As a result, none of these provide an easy, single-finger mounted switch to remotely operate a wrist-mounted flashlight with a significant light source while continuing to work without interrupting the hand from its normal activity.

There have also been efforts to improve flashlights that attach to firearms and their associated rail mounting systems. For example, U.S. Pat. No. 7,441,918 B2 improves on the standard firearm mounted flashlight by including a remote switch that attaches to the rail structure connected to the firearm. The remote switching apparatus allows someone who is holding a firearm to more effectively operate the flashlight while also operating the firearm. As a result, this flashlight system is also deficient since the firearm and its secured attachments are all required to be present to maintain operation of the flashlight.

In general, the prior art suffers from a common deficiency in that it requires the user to occupy one hand to turn a flashlight beam on or off or to otherwise control the beam's color, diffusion angle, etc., and when doing so, the beam must be diverted. What is needed is a wrist-mounted flashlight with remote control switch to allow the user to operate the flashlight via the user's fingertips, and thereby illuminate a target while leaving both hands free to work on the target, and moreover to keep the beam directionally trained on the target while controlling the beam.

Thus, it would be greatly advantageous to provide a compact flashlight system that can be worn on the wrist of the user with a method of simple operation via a remote control unit that is attached to the user's finger.

SUMMARY OF THE INVENTION

Objects of the present invention include the following:

It is an object of the present invention to provide a flashlight that can be mounted on the wrist or similar point on the distal portion of a user's arm.

It is another object of the present invention to provide a remote electrical push button switch or capacitive touch switch and associated housing wherein said switch can attach to the user's finger and can be conductively connected to the wrist-mounted flashlight via a flexible cable.

It is still another object of the present invention to preferably provide a cable winding system incorporated into the flashlight device wherein the remote switch can be connected to a flexible cable that extends and retracts via a roll-up spring into the cavity of the wrist-mounted flashlight.

It is still another object of the present invention to provide a cable wrapping system that can secure the flexible remote switch and flexible cable to the wrist-mounted flashlight when it is not in use.

It is still another object of the present invention to provide a coil spring wire that can retract the flexible remote switch and flexible cable close to the wrist-mounted flashlight when it is not in use.

It is still another object of the present invention to provide a simple push button or tap mode-select operation switch that a user can operate to select one of a number of flashlight modes by simple depression or touch of the remote switch attached to the user's finger or optional switch incorporated into the main flashlight unit. The modes may include bright illumination modes, an emergency signaling mode, a rapid disorienting flash mode, other unique lighting modes selected by the user. In some embodiments the modes may include a mode to operate a single light activation without multiple modes of illumination.

In accordance with the foregoing objects, the invention can include a wrist-mounted flashlight with a light unit attached to a wrist band for allowing a user to wear the device on the wrist and a remote control unit that attaches to the finger for allowing the user to control the light unit by finger. The remote control may allow the user to power the light unit on/off and/or switch between multiple lighting display modes using their fingertips. By providing a means to remotely activate the flashlight, the invention can free both hands of the user or free at least all of the fingers except the one used to activate the flashlight. A user can use the flashlight more effectively and economically instead of purchasing limited use items as he or she would have to with the prior art.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention includes a wrist-worn flashlight having a light unit attached to a wrist band for allowing a user to wear the device on the wrist, and a remote control that attaches to the finger for allowing the user to control the light unit by finger. The remote control can allow the user to power the light unit on/off, but may also allow switching between various lighting colors, diffusion angles/patterns, or other display modes. The wrist-worn flashlight enables a user to directionally train the beam on the target, use both hands to work on the target, and additionally control the beam without diverting it.

Figure 1:
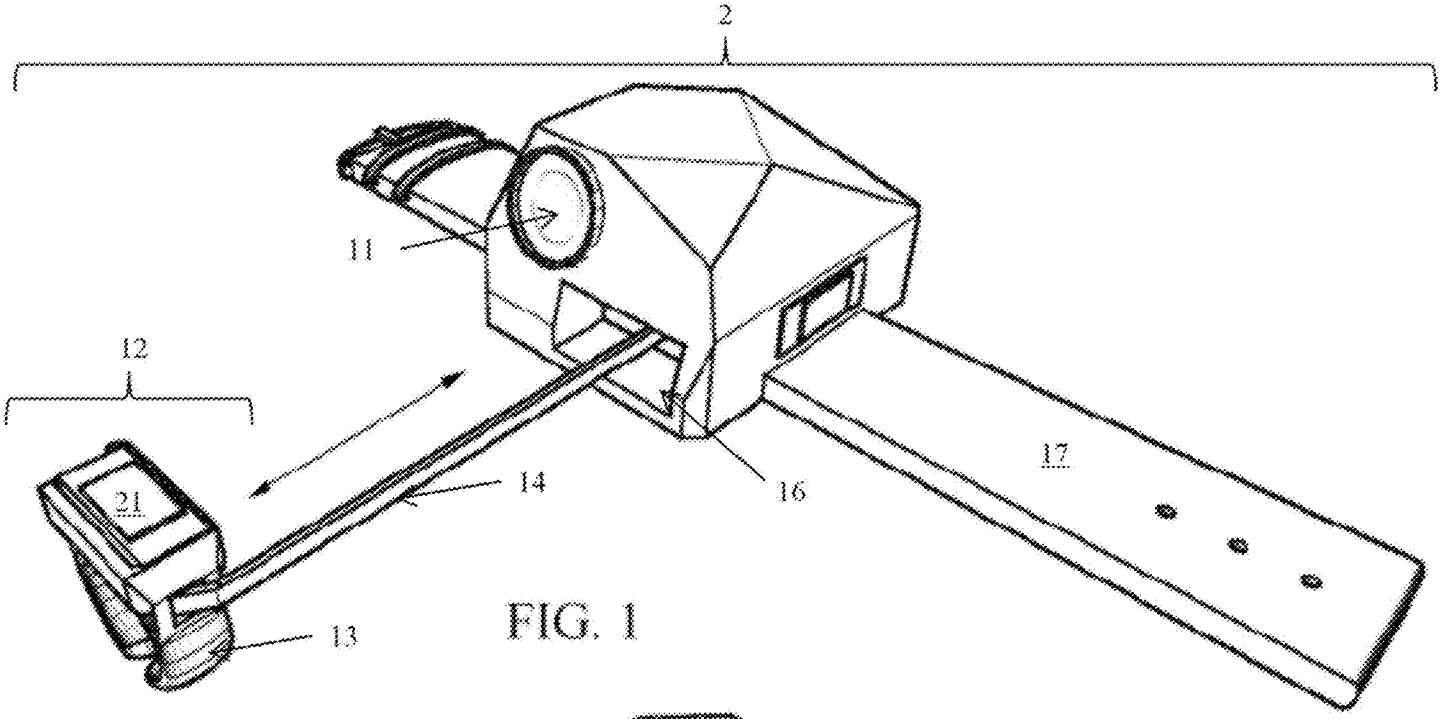
FIG. 1 shows a perspective view of the exemplary wrist-mounted flashlight with remote control switch deployed on its flexible cable and cable winding system in accordance with a preferred embodiment of the present invention.

FIG. 1 shows the wrist-mounted flashlight 2 including lighting unit 11 and remote-retractable control unit 12. The lighting unit 11 can be attached to a wrist strap 17 and configured to be secured thereby around the wrist or distal portion of an arm of a user. The remote control unit 12 can be configured to be attached to the finger by a finger-mount 13 such as an annular ring or finger-strap or other finger connection. The remote control unit 12 can include a power switch 21 to power the lighting unit 11 on/off, and may optionally and additionally include switch(es) for switching between multiple lighting display modes, colors and/or diffusion patterns.

Figure 2:
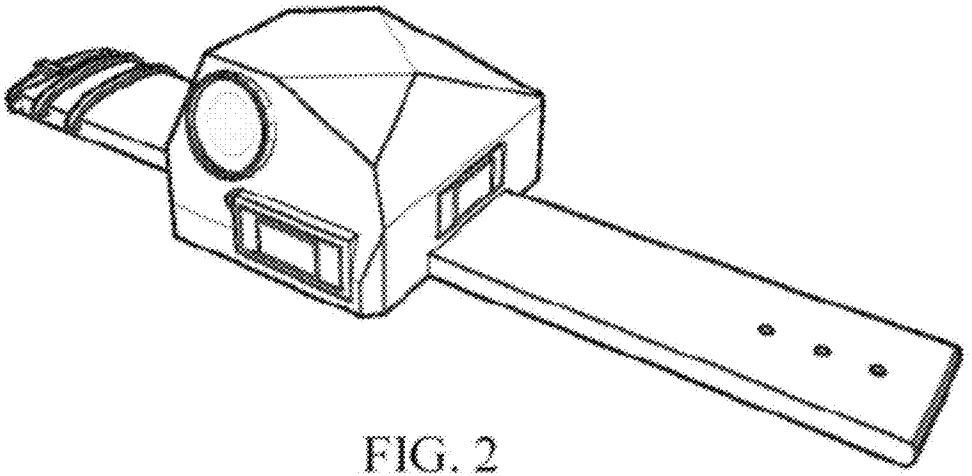
FIG. 2 shows a preferred embodiment of the present invention where the remote control switch has retracted into the main assembly of the wrist-mounted flashlight via the internal cable winding system for easy storage.

The remote control unit 12 can connect to the lighting unit 11 via a flexible cable 14 that can retract into a cavity 16 in the flashlight 2 using an internal cable winding system (not shown), resulting in the stowed configuration shown in FIG. 2. As can be seen in FIG. 1 the switch 21 on the remote control unit 12 may be operated by pressing with either adjacent fingertip to power the lighting unit 11 on and/or off without disrupting the orientation of the beam from the lighting unit 11.

Figure 3:
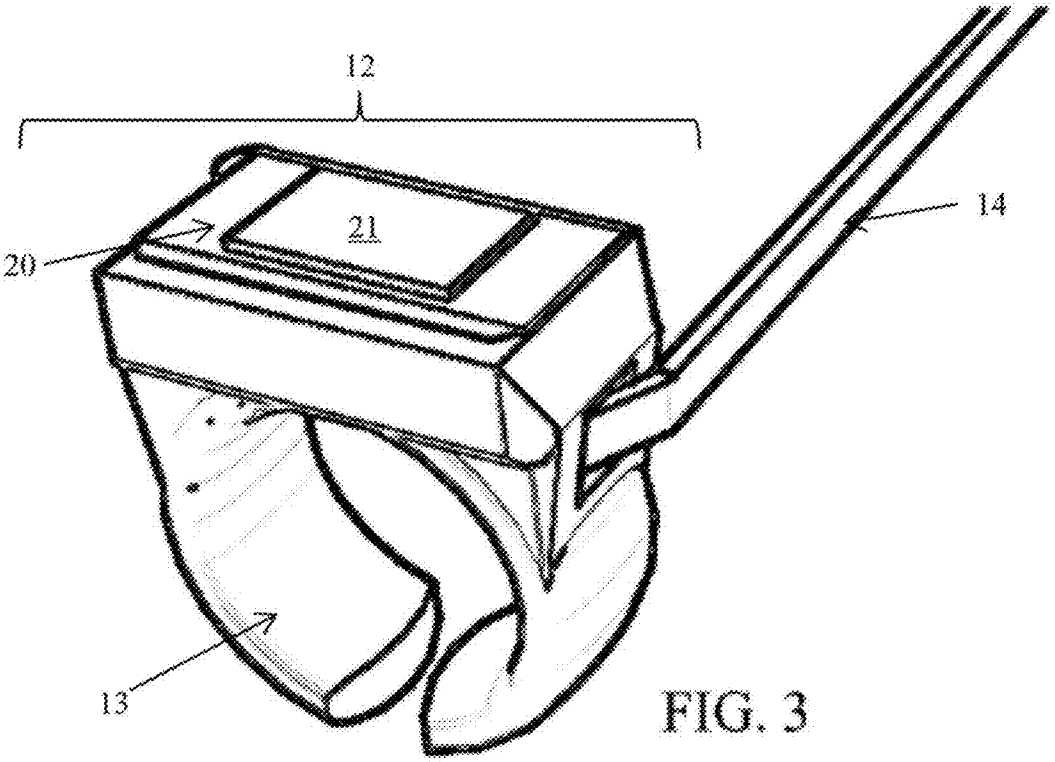
FIG. 3 shows an enlarged perspective view of the remote control unit of the present invention that attaches to a finger and includes a flexible cable to connect to the main wrist-mounted flashlight assembly in accordance with a preferred embodiment of the present invention.

FIG. 3 shows a detailed isolated view of the remote control unit 12 which is preferably mounted atop a resilient two-prong flexible annular ring 13. The remote control unit 12 minimally comprises an enclosed electrical detent switch 21 incorporated into a sealed housing 20 attached to the ring 13. The flexible cable 14 is preferably a coated conductive cable.

Figure 4:
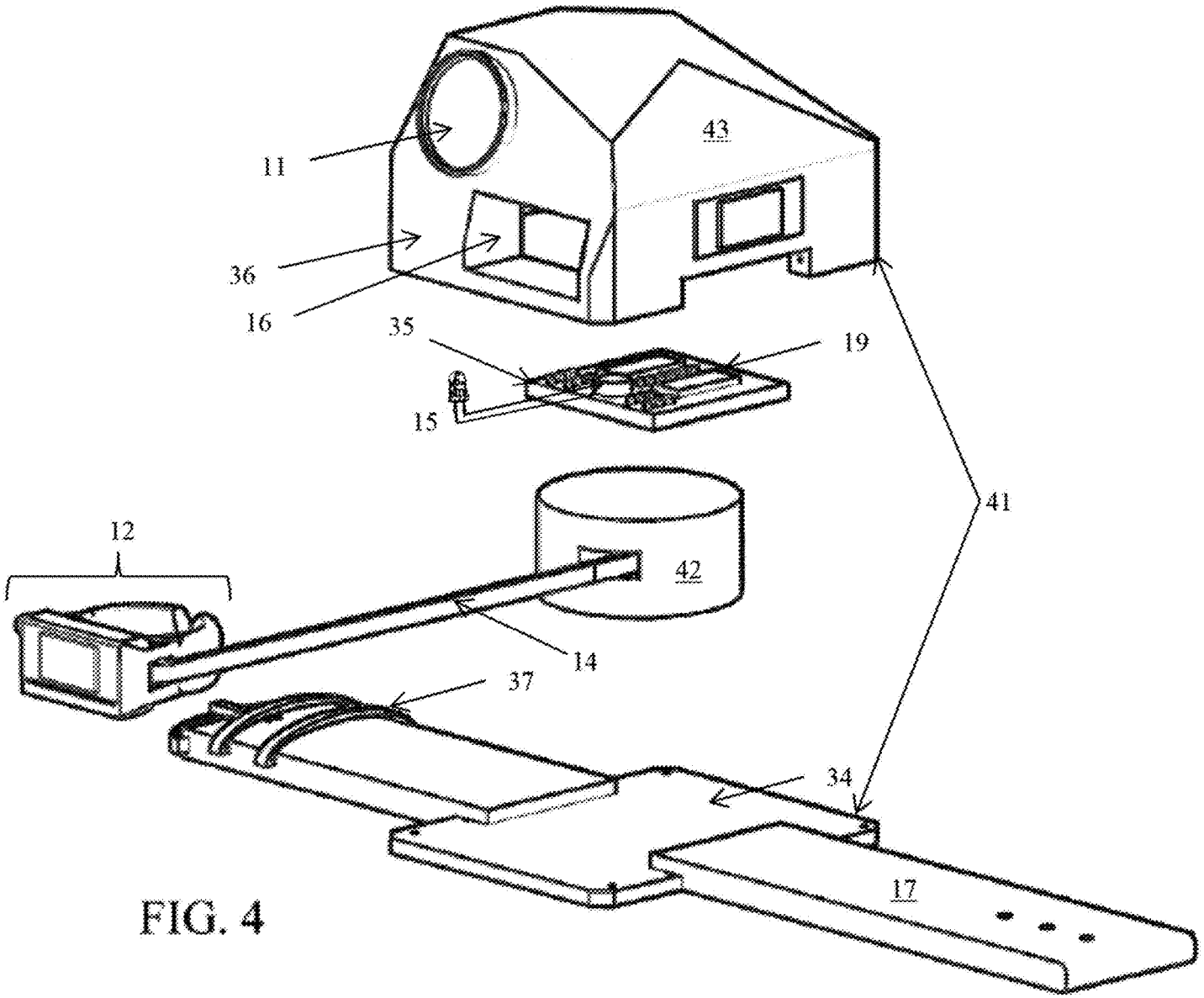
FIG. 4 shows an exploded view of a preferred embodiment of the wrist-mounted flashlight assembly of the present invention that includes an internal cable winding system connected to the external remote control switch.

FIG. 4 is an exploded perspective view of the lighting unit 11 of the present invention mounted on a one or two-piece wrist strap 17 having pass-through stirrups 37. The internal components of the lighting unit 11 preferably include a light emitting diode light source 15 which may be wired to or surface-mounted on a direct current power supply printed circuit board 35 with integral battery 19, all mounted in the base 34 of a two-part housing 41. The LED 15 sits immediately behind the lighting unit 11. The base 34 of the two-part housing 41 can be affixed to the wrist strap 17 by any suitable means. The internal components of the lighting unit 11 can also include the cable winding system 42, which can also be housed within the combined base 34 and cover 43. The housing 41 has a cover 43 that includes a recessed cavity 16 on its front wall 36 in which the remote control unit 12 may be stowed and stored after the flexible cable 14 has been retracted into the cable winding system 42. The flexible cable 14 is preferably connected to circuit board 35 by rotary contacts within the cable winding system 42 which can contact fixed leads in a known manner to permanent fixed-wire contacts on the cable winding system 42. The fixed contacts in turn connect to the direct current power supply printed circuit board 35 so that the remote control unit 12 can activate the light source 15.

FIG. 4 shows an embodiment of the cable winding system 42 comprising a spring-wound coil retractor by which the remote control unit 12 may be retracted by cable 14 into the cavity 16 on the front wall 36 of the lighting unit 11 housing 41. Whenever the wrist-mounted flashlight 2 is not in use the flexible cable 14 can be retracted by the cable winding system 42 and the remote control unit 12 along with the finger ring 13 docked and stowed into the cavity 16 for easy storage.

Figure 5:
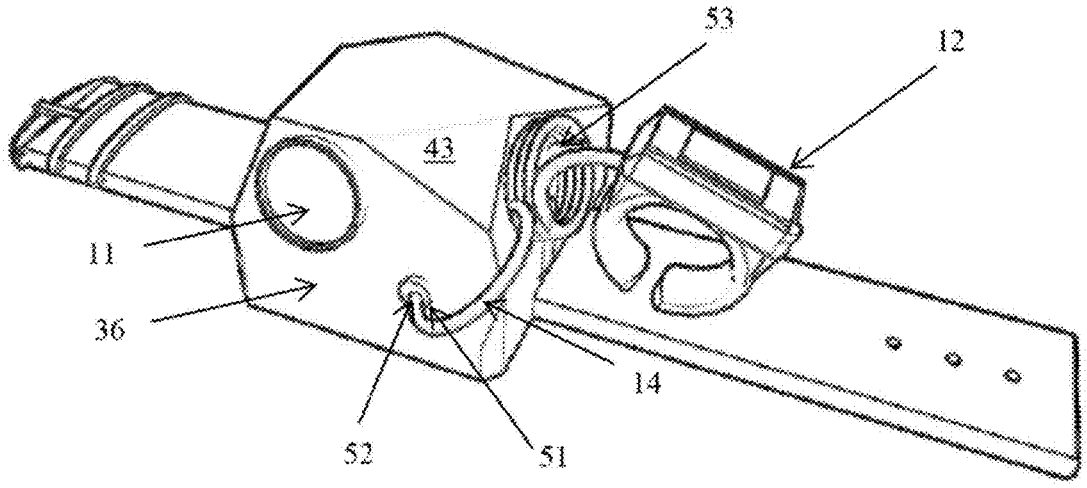
FIG. 5 shows an alternative embodiment of the present invention that includes an external cable connected to the remote control switch that wraps and secures to the external shell of the flashlight instead of an internal cable winding system that retracts the remote control switch cable into the flashlight assembly.

FIG. 5 shows an alternative embodiment of the invention where there is no cable winding system 42 incorporated into the lighting unit 11. Instead, the flexible cable 14 can enter the front wall 36 of the lighting unit 11 via a small coupling port 51 where it can be permanently secured or temporarily secured via a plug-in-receptacle connection 52. Since, in such embodiments, the flexible cable 14 may not retract into a cavity 16 in the lighting unit 11, the cable may be manually wrapped around cleats 53 or similar elevated attachment features on the exterior of the cover 43 to keep the flexible cable 14 and remote control unit 12 in place when they are not in use.

Figure 6:
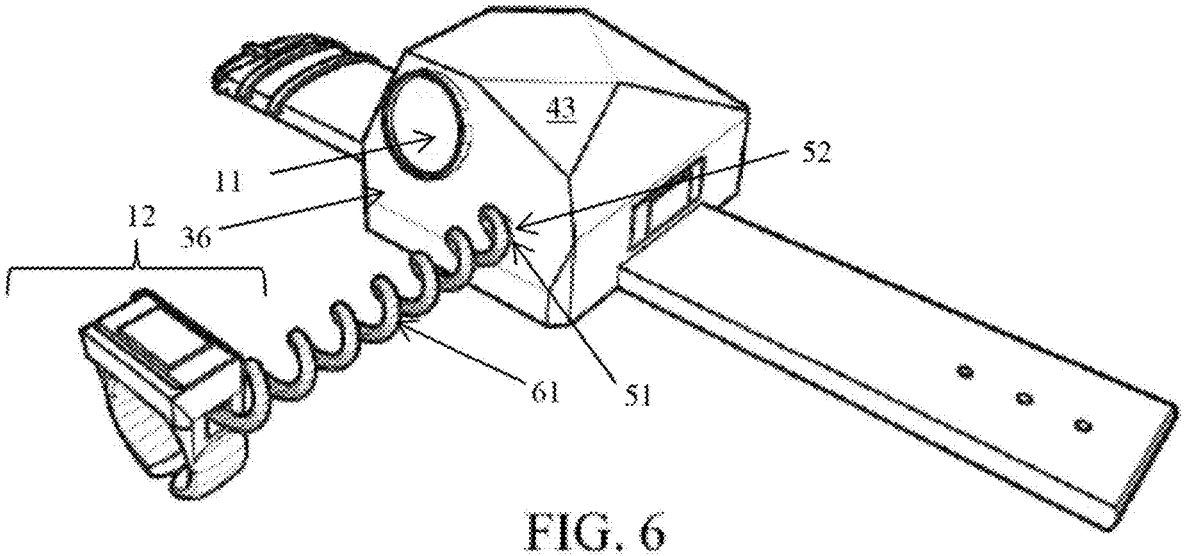
FIG. 6 shows an alternative embodiment of the present invention that includes an external shape-memory cable connected to the remote control switch that is coiled and secures to the external shell of the flashlight instead of an internal cable.

FIG. 6 shows yet another alternative embodiment where there is no cable winding system 42 incorporated into the lighting unit 11. Instead, the cable 14 can be a shape-memory coil spring cable 61 that enters the front wall 36 of the lighting unit 11 via a small coupling port 51 where it can be permanently secured or temporarily secured via a plug-in-receptacle connection 52. The flexible coil spring cable 61 may not retract into a cavity 16, and may retain its coiled shape memory and retract closely to the exterior housing of the cover 43 to keep the flexible coil spring cable 61 and remote control unit 12 close to the lighting unit 11 when they are not in use.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. In all such cases, the result is a more aesthetically pleasing or customized for appearance or practical, functional purposes wrist-mounted flashlight with remote control switch in a commercially manufacturable configuration that modifies the aesthetics and/or appearance while preserving the integrity and functional structure of the flashlight so as not to depart from established standards.

For the purposes of this disclosure, unless expressly stated otherwise: (a) the use of singular forms of terms include plural forms; (b) the use of the terms "including," "having," and similar terms are deemed to have the same meaning as "comprising" and thus should not be understood as limiting; (c) the term "set" or "subset" means a collection of one or more than one elements; (d) the term "plurality" means a collection of two or more elements; (e) the term "such as" means for example; (f) the term "and/or" means any combination or sub-combination of a set of stated possibilities, for example, "A, B, and/or C," means any of: "A," "B," "C," "AB," "AC," or "ABC;" and (g) headings, numbering, bullets, or other structuring of the text of this disclosure is not to be understood to limit or otherwise affect the meaning of the contents of this disclosure.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A wrist-mounted flashlight with remote control comprising:

a band configured to be worn on a user's arm or wrist;

a housing attached to said band;

a lighting unit contained within said housing, said lighting unit comprising a printed circuit board, a battery, and an illumination source;

a flexible cable having one end in electrical contact with said printed circuit board and extendable outside of said housing; and a remote control unit in electrical contact with another end of said flexible cable, said remote control unit comprising an integral finger mount for attachment to a finger of the user.

2. The wrist-mounted flashlight according to claim 1, wherein said remote control unit is retractable into a cavity of said housing.

3. The wrist-mounted flashlight according to claim 1, further comprising a cable winding system contained within said housing, wherein said flexible cable is extendable via said cable winding system.

4. The wrist-mounted flashlight according to claim 1, wherein said integral finger mount comprises an annular ring.

5. The wrist-mounted flashlight according to claim 1, wherein said integral finger mount comprises a flexible annular ring having two prongs.

6. The wrist-mounted flashlight according to claim 1, wherein said lighting unit comprises at least two selectable light emission modes selected from the group consisting of: a brightness mode, a light color mode, a light diffusion pattern mode, an emergency signaling mode, and a rapid disorienting flash mode.

7. The wrist-mounted flashlight according to claim 1, wherein said integral finger mount comprises one or more switches for performing at least one operation selected from the group consisting of: powering said lighting unit on or off, selecting a brightness mode, selecting a light color mode, selecting a light diffusion pattern mode, selecting an emergency signaling mode, and selecting a rapid disorienting flash mode.

8. The wrist-mounted flashlight according to claim 1, wherein said integral finger mount comprises one or more switches configured to be operable by a fingertip of said user that is adjacent to said finger of said user.

9. The wrist-mounted flashlight according to claim 1, wherein said integral finger mount comprises and annular ring and one or more electrical detent switches incorporated into a sealed housing attached to said annular ring.

10. The wrist-mounted flashlight according to claim 1, wherein said illumination source comprises a light emitting diode.

11. The wrist-mounted flashlight according to claim 1, wherein said lighting unit comprises a swivel socket housing said illumination source allowing said illumination source to be more finely trained on a lighting target.

12. The wrist-mounted flashlight according to claim 1 wherein said flexible cable is removably secured to said housing via a plug-in-receptacle connection.

13. The wrist-mounted flashlight according to claim 3, wherein said housing is formed with an external cavity and said remote control unit seats into said cavity.

14. A wrist-mounted flashlight with remote control comprising:

a band configured to be worn on an arm or wrist of a user;

a housing attached to said band;

a lighting unit contained within said housing, said lighting unit comprising a printed circuit board, a battery, and an illumination source;

a flexible cable having one end in electrical contact with said printed circuit board and extendable outside of said housing;

an attachment component attached to an exterior of said housing for wrapping said flexible cable; and a remote control unit in electrical contact with another end of said flexible cable, said remote control unit comprising an integral finger mount for attachment to a finger of the user.

15. The wrist-mounted flashlight according to claim 14, wherein said flexible cable is removably secured to said housing via a plug-in-receptacle connection.

16. The wrist-mounted flashlight according to claim 14, wherein said flexible cable is permanently secured to said housing.

17. The wrist-mounted flashlight according to claim 14, wherein said attachment component comprises one or more elevated cleats.

18. A wrist-mounted flashlight with remote control comprising:

a band configured to be worn on an arm or wrist of a user;

a housing attached to said band;

a lighting unit contained within said housing, said lighting unit comprising a printed circuit board, a battery, and an illumination source;

a flexible shape-memory coil spring cable having one end in electrical contact with said printed circuit board and extendable outside of said housing; and a remote control unit in electrical contact with another end of said flexible cable, said remote control unit comprising an integral finger mount for attachment to a finger of the user.

19. The wrist-mounted flashlight according to claim 18, wherein said flexible shape-memory coil spring cable is removably secured to said housing via a plug-in-receptacle connection.

20. The wrist-mounted flashlight according to claim 18, wherein said flexible shape-memory coil spring cable is permanently secured to said housing.

* * * * *